United States Patent [19]

Takada et al.

[11] 4,287,864

[45] Sep. 8, 1981

[54] AIR-FUEL MIXTURE RATIO CONTROL DEVICE

[75] Inventors: Shigetaka Takada, Ohbu; Kazumichi Naruse, Nagoya, both of Japan

[73] Assignee: Aisan Industry Co., Ltd., Aichi, Japan

[21] Appl. No.: 78,744

[22] Filed: Sep. 25, 1979

[30] Foreign Application Priority Data

Oct. 9, 1978 [JP] Japan ..... 53/138740[U]

[51] Int. Cl.[3] ..... F02B 33/00; F22M 17/00

[52] U.S. Cl. ..... 123/440; 123/438; 137/533.17; 251/129; 251/141

[58] Field of Search ..... 137/533.17; 251/129, 251/141; 123/119 EC, 32 EE, 440, 438, 1

[56] References Cited

U.S. PATENT DOCUMENTS

| | | | |
|---|---|---|---|
| 3,452,780 | 7/1969 | Faustini | 251/141 |
| 3,470,892 | 10/1969 | Barker | 251/141 |
| 4,027,637 | 6/1977 | Aono | 123/119 EC |
| 4,105,726 | 8/1978 | Lindberg | 123/119 EC |

*Primary Examiner*—Ronald B. Cox

[57] ABSTRACT

An air-fuel ratio control device characterized by the fact that an electromagnetic valve which controls the air bleed quantities for both high- and low-speed fuel systems simultaneously has a pin inserted in a valve disc so as to prevent the rotation of the valve disc but allow it to move axially for open-close operation, so that the valve disc and the seat always contact at the same contacting portion and maintain a perfect seal therebetween. This enables an accurate control of the air bleed quantitiy and therefore of the air-fuel ratio.

6 Claims, 3 Drawing Figures

AIR-FUEL MIXTURE RATIO CONTROL DEVICE

BACKGROUND OF THE INVENTION

This invention relates generally to an air-fuel mixture ratio control device for controlling the air-fuel ratio of the fuel mixture in a carburetor by using an exhaust gas sensor, and more specifically the invention relates to an improvement in an electromagnetic valve which serves as an actuator for air bleed control.

FIG. 1 shows an air-fuel mixture ratio control device using a conventional electromagnetic valve. An engine body 10 is operatively connected to a suction manifold 10 and to an exhaust manifold 12 on which an exhaust gas sensor 13 is disposed. A carburetor body 20 is provided in which there is a small venturi pipe 21, a large venturi pipe 22 and a throttle valve 23. A float chamber 24 communicateds via ports with the carburetor body 20. There are also formed an air inlet 25 for electromagnetic valve 40, an air bleed control port 26 for a high-speed fuel system and an air bleed control port 27 for a low-speed fuel system. A control circuit 30 is connected to a battery 31 and the exhaust gas sensor 13 and an electromagnetic valve having a valve body 40, a case 41 for the valve, coils 42 and lead wires 43 connected to the control circuit 30, and a spring 44, an armature 45, a valve 46 cooperating with a seat 47, an air inlet 48, an air bleed control port 49 for a high-speed fuel system, and an air bleed control port 49*a* for a low-speed fuel system. Referring to FIG. 1, when the coil 42 is energized or de-energized, the armature 45 is moved up and down by the electromagnetic attraction and by the spring 44, thereby opening and closing the seat 47 of the valve 46. The coil 42 is applied with a rectangular wave pulse signal of a constant frequency. By controlling the time ratio between "on" and "off" in the pulse signal (a duty ratio), i.e., an open-close time ratio of the valve 46, the quantity of air bleed is controlled as a function of the duty ratio.

In the conventional air-fuel mixture ratio control device in which the air bleeds for both the high- and low-speed fuel systems are simultaneously controlled by one electromagnetic valve, it is difficult to form a complete seal between the valve 46 and the seat 47 when the valve is closed because every time the valve 46 opens or closes, it rotates and the contacting portion between the vlve 46 and the seat 47 shifts as the valve rotates. The imperfect seal between the valve 46 and the seat 47 as caused by the rotation of the valve 46 not only makes it impossible to accurately control the quantity of the air bleed, but it also allow the bleed air to flow between the ports 26 and 27 of the carburetor 20 resulting in a change in the air-fuel ratio and in a worst case a stoppage of the engine during idling.

SUMMARY OF THE INVENTION

It is an object of the present invention to provide an improved air-fuel mixture ratio control device in which the valve 46 is prevented from rotating and the seat 47 and the valve 46 contact always at the same contacting portion when the valve is closed, so as to ensure a complete seal between the valve 46 and the seat 47.

To achieve this objective, an air-fuel mixture ratio control device according to the present invention includes an electromagnetic valve which has a pin inserted in the valve disc in such a manner that the valve cannot rotate but is only allowed to move axially for an open-close operation.

DESCRIPTION OF THE PREFERRED EMBODIMENTS

Figure 2:
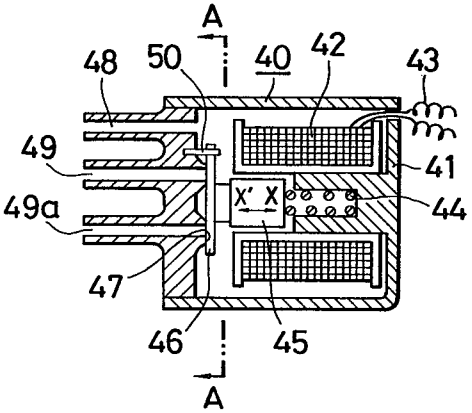
FIG. 2 is a cross-sectional view of an air-fuel mixture ratio control device according to the present invention.
Figure 3:
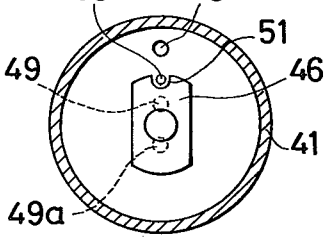
FIG. 3 is a cross-sectional view taken along the line A—A of FIG. 2.
Figure 1:
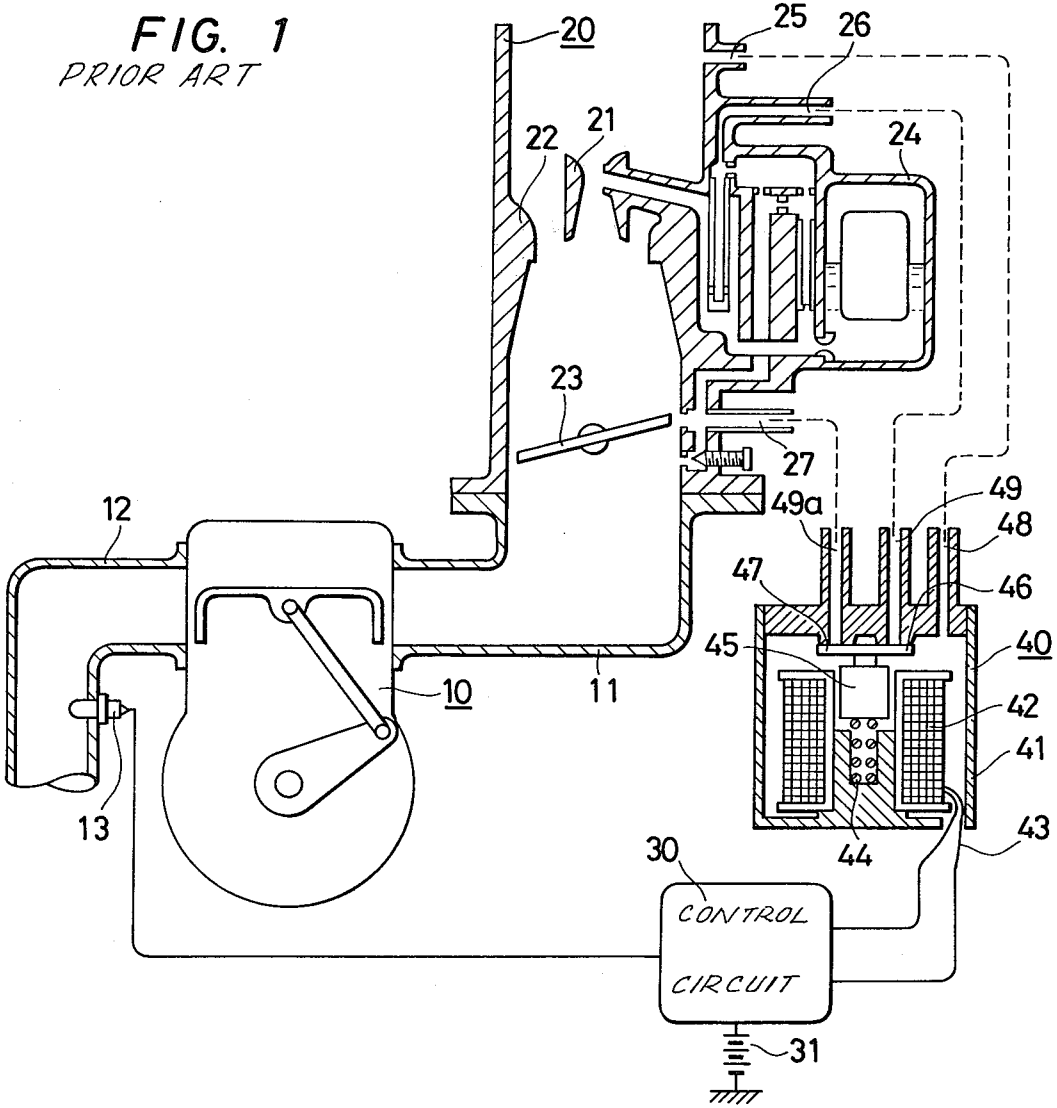
FIG. 1 PRIOR ART
FIG. 1 is a cross-sectional view of a conventional air-fuel mixture ratio control device.

FIGS. 2 and 3 show one embodiment of the present invention. A pin 50 is embedded in a case 41 and inserted in a U-shaped groove 51 formed on the valve 46. The length of the pin 50 is set larger than that of the open-close stroke of the valve 46.

When the valve is moved by the electromagnetic attraction away from the seat 47 in the direction X'-X, the spring 44 is compressed and the compressed spring 44 in turn imparts rotary force to the armature 45 and therefore to the valve 46. However, the rotation of the valve 46 is obstructed by the pin 50.

When the coil 42 is in a de-energized state, the compressive and torsional force of the spring 44 also tends to cause the valve 46 to rotate. But, since the pin 50 is inserted in the valve 46, the valve 46 is kept from rotating.

According to this invention, the valve is prevented from rotating to ensure contact between the valve and the seat at the same contacting portion so that a perfect seal can be maintained between the valve and the seat. The complete seal which is obtained when the valve 46 is fully closed prevents leakage of the bleed air and enables accurate control of the air bleed quantity so that a desired air-fuel ratio can be maintained.

What is claimed is:

1. An air-fuel mixture ratio control device for controlling air-fuel mixture ratio in a carburetor which supplies a fuel mixture to an engine and has high speed and low speed systems with air bleed intake ports, comprising a feed-back loop including an exhaust gas sensor means for detecting the air-fuel ratio of the fuel mixture, the air bleed intake ports of said high speed and low speed fuel systems each being projected forming two air bleed control ports, an actuator means for controlling air bleed quantities for both the high speed and low speed fuel systems in the carburetor which supplies the fuel mixture to the engine, a control circuit means for driving said actuator means in dependency on a signal from said exhaust gas sensor means, said actuator means comprising, means comprising a single, rotatable solenoid valve axially moveably mounted with a stroke of the valve for simultaneously opening and closing respectively said air bleed control ports of said high speed and low speed fuel systems, said solenoid valve having an armature, a plate-shaped valve member mounted on said armature and a valve seat portion, said air bleed control ports extending in said valve seat portion, a pin means projecting from said valve seat portion operatively engages said plate-shaped valve member over the stroke of said valve, for preventing rotation of said valve member, said plate-shaped valve member is substantially rectangular, is centrally connected to said armature and is formed with a U-shaped groove in one narrow edge of said plate-shaped valve member, said pin has a free end remote from said valve seat portion and a length from said free end to said valve seat portion slightly greater than the stroke of said valve, said pin freely extends into said U-shaped groove from one side and said free end extends beyond the other side of said valve member in at least a postion of the latter against said valve seat portion.

2. The air-fuel mixture ratio control device as set forth in claim 1, wherein said seat portion projects toward said plate-shaped valve member.

3. The control device as set forth in claim 1, further comprising a helical spring acts against a side of said armature remote from said valve member and operatively provides a torsional force on said armature.

4. The control device as set forth in claim 1, wherein said valve seat portion has two projecting portions projecting toward said plate-shaped valve member, said projecting portions are aligned corresponding to a central longitudinal axis of said plate-shaped valve member on respective sides of a center of said valve member, said control ports are formed on said projecting portions.

5. The control device as set forth in claim 4, wherein an air outlet is formed in a case wall of said actuator means, said valve seat portion is formed on said case wall, said air inlet is aligned with said control ports in said projecting portions and is located adjacent said U-shaped groove, the latter being aligned between said air inlet and an adjacent of said control ports.

6. The control device as set forth in claim 4, wherein said valve member has a flat surface engaging said valve seat portion and simultaneously closing said two control ports.

* * * * *